US011904992B2

(12) United States Patent
Price et al.

(10) Patent No.: US 11,904,992 B2
(45) Date of Patent: Feb. 20, 2024

(54) AUTONOMOUSLY DEPLOYING EFFECTS ON WATER BODY BED

(71) Applicant: The United States of America, as represented by the Secretary of the Navy, Arlington, VA (US)

(72) Inventors: Christopher M Price, Monterey, CA (US); Paul R Leary, Monterey, CA (US); Brian S Bingham, Pacific Grove, CA (US)

(73) Assignee: The Government of the United States of America, as represented by the Secretary of the Navy, Washington, DC (US)

( * ) Notice: Subject to any disclaimer, the term of this patent is extended or adjusted under 35 U.S.C. 154(b) by 482 days.

(21) Appl. No.: 17/236,975

(22) Filed: Apr. 21, 2021

(65) Prior Publication Data

US 2021/0323645 A1 Oct. 21, 2021

Related U.S. Application Data

(60) Provisional application No. 63/013,380, filed on Apr. 21, 2020.

(51) Int. Cl.
*B63G 8/00* (2006.01)
*B63G 8/20* (2006.01)

(52) U.S. Cl.
CPC ..... *B63G 8/001* (2013.01); *B63G 8/20* (2013.01); *B63G 2008/004* (2013.01)

(58) Field of Classification Search
CPC .... B63G 8/001; B63G 8/20; B63G 2008/004; B63G 8/14; B63C 11/42
(Continued)

(56) References Cited

U.S. PATENT DOCUMENTS

2011/0297070 A1* 12/2011 Riggs ..... B63H 25/42 114/330
2019/0100292 A1* 4/2019 Austin ..... B63G 8/22
(Continued)

OTHER PUBLICATIONS

Chua, Weng Heng (Jun. 2009) "Flow visualization studies over a UCAV 1303 model," M.S. Thesis. Naval Postgraduate School, Monterey, CA.

(Continued)

*Primary Examiner* — Mahmoud S Ismail
(74) *Attorney, Agent, or Firm* — Naval Postgraduate School; Scott Bell

(57) ABSTRACT

The invention relates to a payload frame for deploying a payload underwater. The payload frame includes at least three lead screws, each lead screw connected near a top end of the lead screw to the payload by a corresponding spherical bearing; at least three motors, each motor connected to a bottom end of one of the lead screws, the motor to rotate the lead screw through the corresponding spherical bearing; at least three feet, each foot attached to one of the motors, the feet to support and secure the payload frame on a water body bed; an accelerometer attached to the payload, the accelerometer to measure gravity vectors of the payload; and a microcontroller connected to the accelerometer and the motors. The microcontroller to receive the gravity vectors from the accelerometer and control each of the motors based on the gravity vectors to position the payload in a target orientation.

14 Claims, 5 Drawing Sheets

(58) Field of Classification Search
USPC ..... 701/21
See application file for complete search history.

(56) References Cited

U.S. PATENT DOCUMENTS

2020/0147783 A1* 5/2020 Crawford ..... B25J 9/102
2020/0255145 A1* 8/2020 Goddard ..... B64C 39/024

OTHER PUBLICATIONS

Fridstrom Johan ( 2015) "Some statistical properties of the ambient noise in the Baltic Sea and its relation to passive sonar." M.S. Thesis, School of Naval Architecture, Stockholm, Sweden, https://pdfs.semanticscholar.org/2d47/72fc353f92a745b5a1e168c9dc95fa3a81dc.

Hamilton, Edwin L. (Aug. 13, 1980) "Geoacoustic modeling of the sea floor," The Journal of the Acoustical Society of America, vol. 68, No. 5, pp. 1313-1340.

Price, William D. (Dec. 2006) "Control system of a three DOF spacecraft simulator by vectorable thrusters and control moment gyros," M.S. & A.E. thesis, Naval Postgraduate School, Monterey, CA. http://hdl.handle.net/10945/2350.

Price, William D, Chau Ton, William Mackunis, and Sergey V. Drakunov (Jul. 17-19, 2013) "Self-reconfigurable control for dual-quaternion/dual-vector systems," 2013 European Control Conference (ECC).

Price, William D, (2013) Nonlinear Control for Dual Quaternion Systems. Daytona Beach, FL: Embry-Riddle Aeronautical University.

Van Dijk, Thaienne A. G. P. and M. G. Kleinhans, (Nov. 2005) "Processes controlling the dynamics of compound sand waves in the North Sea, Netherlands," Journal of Geophysical Research: Earth Surface, vol. 110, No. F4. https://doi.org/10.1029/2004JF000173.

* cited by examiner

AUTONOMOUSLY DEPLOYING EFFECTS ON WATER BODY BED

CROSS-REFERENCE TO RELATED APPLICATIONS

This application claims the benefit of U.S. Provisional Application No. 63/013,380, filed Apr. 21, 2020, which is hereby incorporated in its entirety by reference.

BACKGROUND OF THE INVENTION

1. Field of the Invention

The present invention relates generally to methods and systems for deploying a payload underwater and its variants.

2. Description of the Related Art

Water vessels or unmanned underwater vehicles can be used to deploy payloads to a water body bed. The payload can be mounted to a frame, which is released into the water. The frame descends until the bed is reached to deploy the payload. In some cases, the payload can be repositioned remotely by, for example, acoustic pulses. Repositioning of the payload can be disrupted by a complicated bed with mostly unknown features and unpredictable oceanographic properties.

SUMMARY OF THE INVENTION

Embodiments in accordance with the invention relate to a method and system for deploying a payload underwater. In some embodiments, payload frame includes at least three lead screws, each lead screw connected near a top end of the lead screw to the payload by a corresponding spherical bearing; at least three motors, each motor connected to a bottom end of one of the lead screws, the motor to rotate the lead screw through the corresponding spherical bearing; at least three feet, each foot attached to one of the motors, the feet to support and secure the payload frame on a water body bed; an accelerometer attached to the payload, the accelerometer to measure gravity vectors of the payload; and a microcontroller connected to the accelerometer and the motors. The microcontroller to receive the gravity vectors from the accelerometer and control each of the motors based on the gravity vectors to position the payload in a target orientation.

Embodiments in accordance with the invention are further described herein with reference to the drawings.

DETAILED DESCRIPTION OF THE INVENTION

For illustrative purposes, the principles of the present disclosure are described by referencing various exemplary embodiments. Although certain embodiments are specifically described herein, one of ordinary skill in the art will readily recognize that the same principles are applicable to and can be employed in other systems and methods.

Before explaining the disclosed embodiments of the present disclosure in detail, it is to be understood that the disclosure is not limited in its application to the details of any particular embodiment shown. Additionally, the terminology used herein is for the purpose of description and not of limitation. Furthermore, although certain methods are described with reference to steps that are presented herein in a certain order, in many instances, these steps may be performed in different order as may be appreciated by one skilled in the art; the method embodiments described are therefore not limited to the particular arrangement of steps disclosed herein.

It is be noted that as used herein and in the appended claims, the singular forms "a", "an", and "the" include plural references unless the context clearly dictates otherwise. Furthermore, the terms "a" (or "an"), "one or more" and "at least one" can be used interchangeably herein. The terms "comprising", "including", "having" and "constructed from" can also be used interchangeably.

As noted above, a complicated water body bed of mostly unknown features and unpredictable oceanographic properties can disrupt deployment of a payload. Embodiments of the invention describe a payload deployment system that can actively deploy a payload in a target orientation. After the payload deployment system is released and descends to the water body bed, the legs of the payload deployment system can be independently adjusted to properly orientate the payload with respect to the water body bed.

Figure 1A:
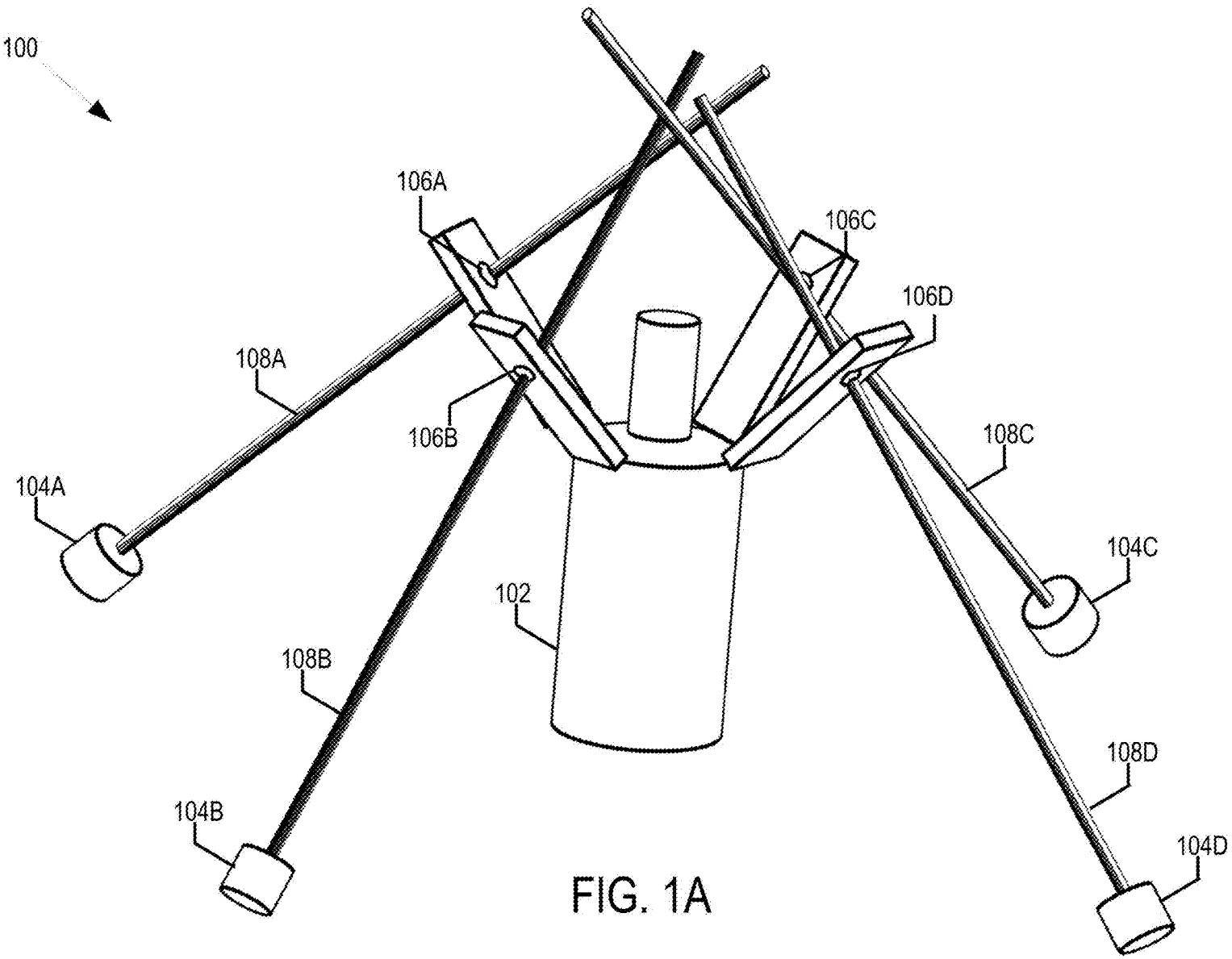
FIG. 1A shows a payload frame for deploying a payload underwater in accordance with embodiments.

FIG. 1A shows a payload frame 100 for deploying a payload underwater in accordance with embodiments. The payload frame 100 includes a payload 102, motors 104A-D, spherical bearings 106A-D, and lead screws 108A-D. In some embodiments, each motor 104A-D can be rigidly attached to a corresponding lead screw 104A-D with no rotation between them. Each motor 104A-D can include a foot (not shown) for securing the payload frame 100 on the water body bed. The weight of the payload 102 secures the feet of the motors 104A-D on the water body bed, which allows the payload frame 100 to rotate in all three directions as described below. The spherical bearings 106A-D are fixed within brackets of the payload 102, and each spherical bearing 106A-D can rotate freely around the corresponding lead screw's 108A-D longitudinal axis but, in some cases, only approximately +/−45° around their other two axes. the lead screws 108A-D can move linearly through the spherical bearings 106A-D. Each motor 104A-D can linearly actuation the corresponding lead screw 108A-D through the corresponding spherical bearing 106A-D. The payload 102 can include a ballast (not shown) that is configured to mitigate chances of tipping during descent and subsequent adjustments of the payload's 102 orientation.

Figure 1C:
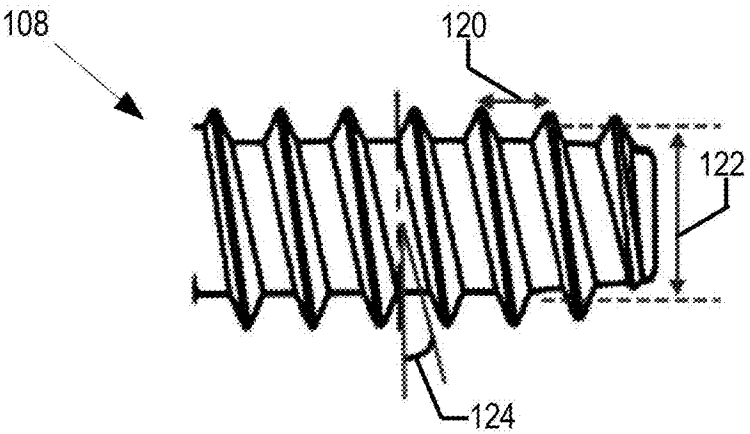
FIG. 1C shows an example lead screw of the payload frame.
Figure 1D:
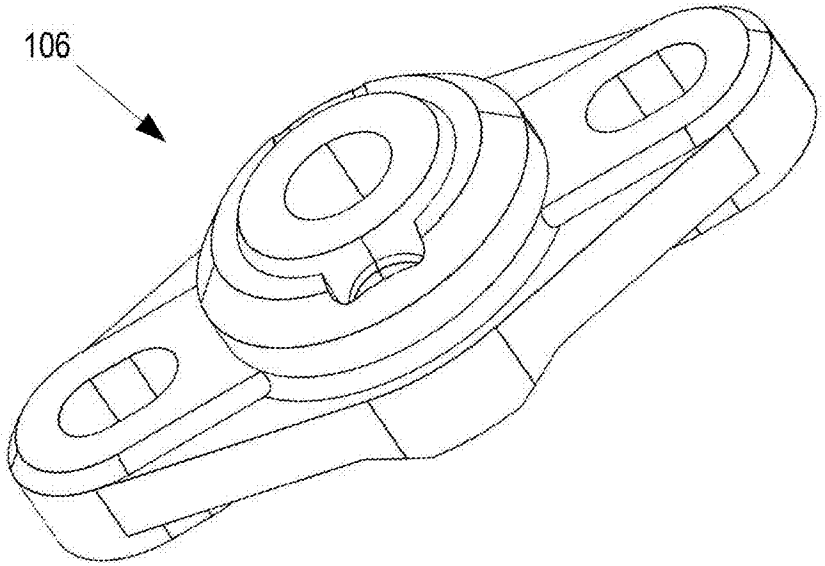
FIG. 1D shows an example spherical bearing of the payload frame.
Figure 1B:
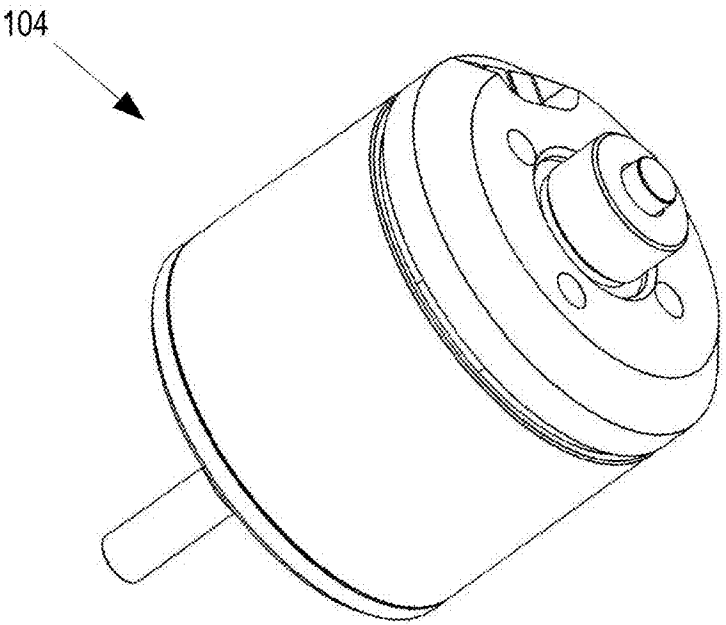
FIG. 1B shows an example motor of the payload frame.

FIG. 1B shows an example motor 104 of the payload frame 100. In one example, each motor 104 count corresponds to approximately 1.8° ($\pi/100=0.0314159$ rad) of rotation around the motor shaft, and the maximum angular velocity is approximately 200.0 rev/min or 1200°/s (20.94 rad/s). Commands for controlling the motor 104 are provided in the form of number of steps for the shaft to rotate. To incorporate this motor 104 input, the linear distance on the lead screws 108A-D (based on the helical lead angle and distance) are correlated to number of motor 104 steps using:

$$\text{linear distance } [m] = (\#\text{ of steps})\left(\frac{1\text{ rev}}{1600\text{ steps}}\right)\left(\frac{12\text{ nm}}{1\text{ rev}}\right)\left(\frac{1\text{ m}}{1000\text{ mm}}\right), \text{ so}$$

$$\text{linear distance } [m] = (\#\text{ of steps})(7.5\times10^{-6}).$$

Figure 4:
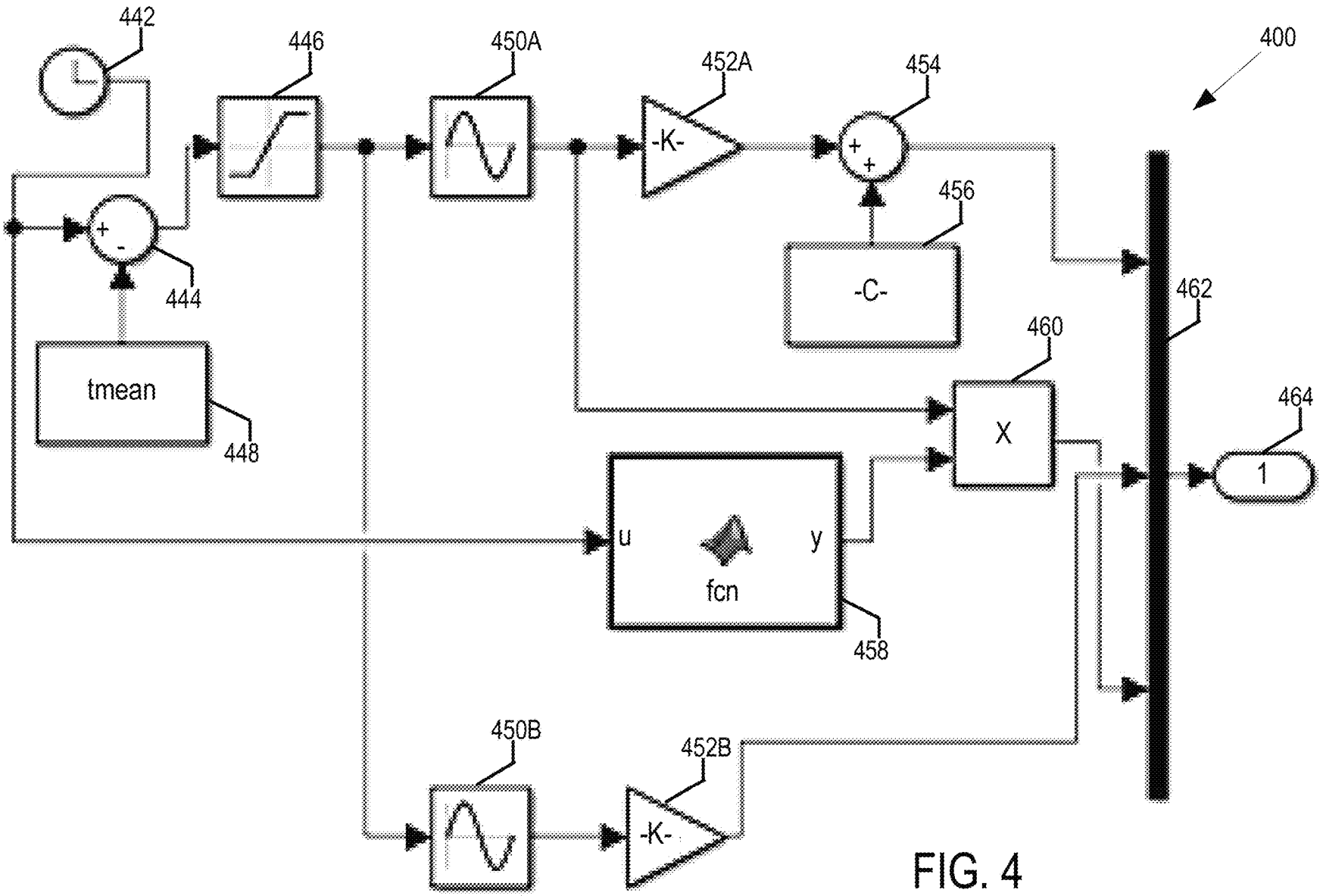
FIG. 4 shows an example smooth step function in accordance with embodiments.

In other embodiments, each motor 104 can provide linear actuation through worm gears instead of coupling each motor 104 shaft directly to the leadscrews 108A-D. In some cases, the motor 104 feet can be configured to auger into the water body bed with a ribbed/helical design. The smooth step function described below in FIG. 4 is used to account for the motor's 104 acceleration needed to reach a desired position.

Each motor 104 may be connected to a stepper motor driver (not shown) to allow commands to be provided to the motor 104.

FIG. 1C shows an example lead screw 108 of the payload frame 100. The rotational motion from one or more of the four motors 104A-D induces translational motion on its respective leg, which are right-hand single-start jack screws 108 where its pitch and lead (λ) are equal, from the motor 104A-D turning β radians. The translational motion can be described in modeling software as position-velocity-acceleration (PVA) and relates to the motor's 104A-D angular position. The relation between rotary and axial motion is a basic trigonometric operation using the shaft 108 helix's lead angle (λ) 124, lead distance 120 (l, axial distance of advancement after one full revolution), and the mean diameter 122 of the helix (d mean) as described in the equation below.

$$\lambda = \tan^{-1}\left(\frac{l}{d_{mean}}\right) \rightarrow l = d_{mean}\tan\lambda$$

Because the motor 104A-D does not turn instantaneously, it is useful to use a smooth-step function for linear actuation as described below with respect to FIG. 4.

FIG. 1D shows an example spherical bearing 106 of the payload frame 100. The threaded spherical bearings 106 can have a rotational range of approximately +/−45° around its x and y axes, but no rotation around its z axis so that the lead screw 108A-D can travel through the bearing 106. In one example, the bearing 106 can be secured to a rectangular rigid surface of the payload 102 that is made of acrylic. In another example, the rigid surface of the payload 102 can be a metallic material to ensure rigidity. The rectangles rigid surfaces can each be secured to an angular support bent to approximately 35° past a right angle, which can then be secured to a case lid of the payload 102 on one of the corners facing outward.

Those skilled in the art will appreciate that while this embodiment shows four legs the payload frame 100 could be implemented with any number of legs so long as the legs were able to support the payload on the water body bed (i.e., the payload frame can be implemented with three or more legs).

Figure 2:
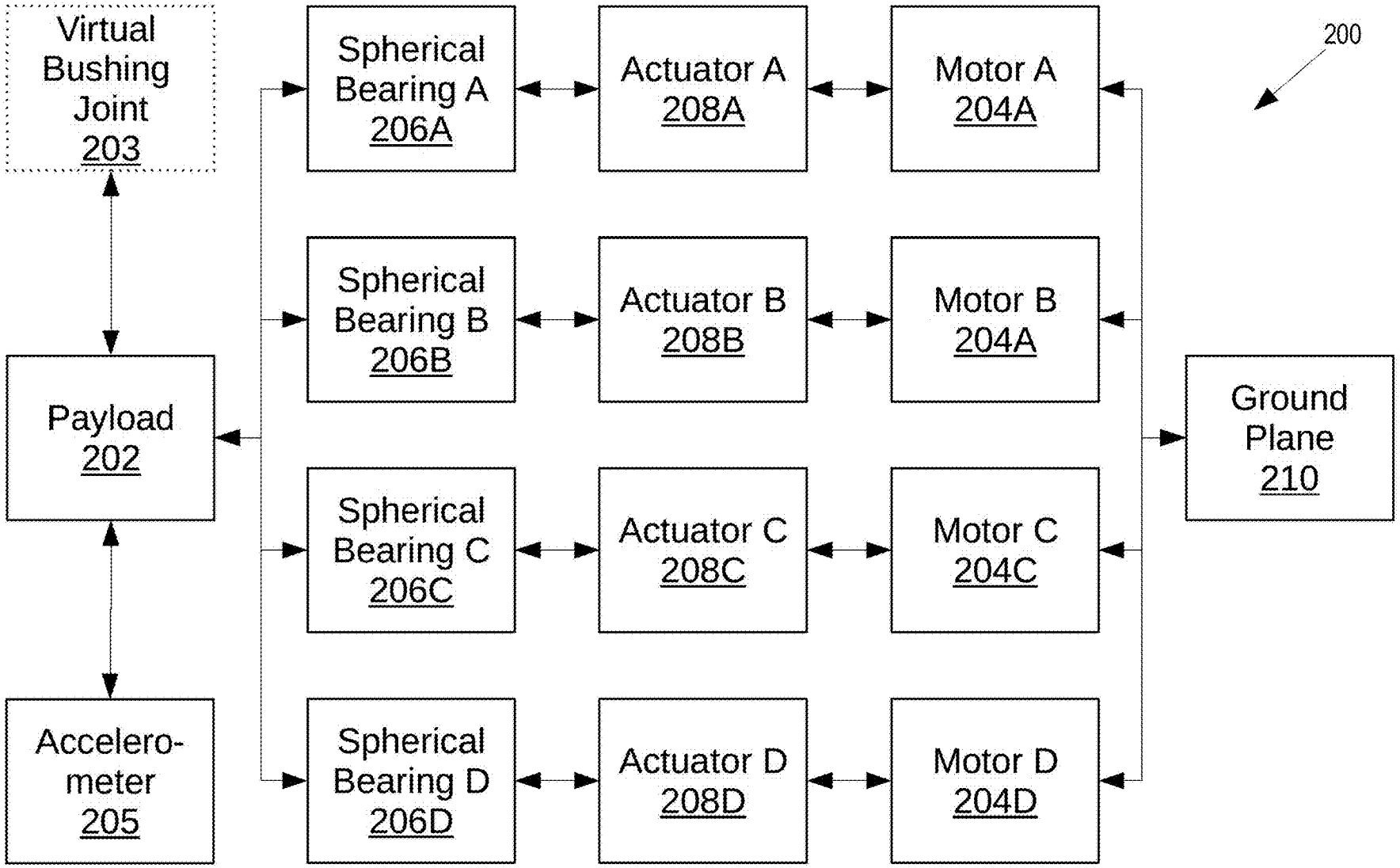
FIG. 2 shows an example schematic for a payload frame in accordance with embodiments.

FIG. 2 shows an example schematic for a payload frame 200 in accordance with embodiments. The payload 202, motors 204A-D, spherical bearings 206A-D, and actuators 208A-D may correspond to the payload 102, motors 104A-D, spherical bearings 106A-D, and lead screws 108A-D described above with respect to FIG. 1.

The payload 202 is connected to an accelerometer 205. For example, an ADXL337 3-axis accelerometer can be used to measure each gravity vector component in x, y, and z by mapping its ±3 g range to an output voltage range of 0–$V_{in}$, which can be sampled at a resolution, n, of 16 bits with an analog-to-digital converter. Given a $V_{in}$ of 3.3 V, the sensor has a sensitivity of 0.0504 mV/g with a 0 g offset voltage of $V_{in}/2$ or 1.65 V. The raw signal can be scaled to [−1, 1] g when the sensor is stationary, where S represents each element of a 1×3 vector, [$S_1$, $S_2$, $S_3$] for $g_z$, $g_y$, and $g_x$, respectively. In some cases, the accelerometer 205 can be mounted to the top of the payload 202. In one example, the +x-axis of the accelerometer 205 can aligned with motor B 204B, −x-axis with motor A 204A, +y-axis with motor D 204D, and −y-axis with motor C 204C. To obtain each gravity component of the accelerometer, the scale and offset can be applied using:

$$G = S*(\text{scale}) + (\text{offset})$$

$$G = S*\left(\frac{V_{in}}{2^n-1}*\frac{1000\frac{\text{mV}}{\text{V}}}{300}\right) - (2^{n-1}-1)\left(\frac{V_{in}}{2^n-1}*\frac{1000\frac{\text{mV}}{\text{V}}}{300}\right).$$

In this example, the accelerometer 205 is oriented so that the accelerometer's 205 x and y coordinates are in line with the motors 204A-D. Furthermore, in some embodiments, the vessel or autonomous underwater vehicle (AUV) should deploy the payload frame 200 so that the accelerometer's 205 coordinate system's x-axis or y-axis is coincident with the steepest gradient of the water body bed. This deployment should reduce error dramatically in the attitude control process. If the payload 202 is not lined up relatively close to the direction of the steepest gradient, then there is a window of approximately +/−30° in which the payload 202 will be able to point directly downward in line with the gravity vector within the predetermined tolerance. The motor 204A-D commands can be configured to fall within the maximum allowable position change based on the length of the lead screws 208A-D. Accordingly, the payload frame 200 is stable and controllable within the desired threshold so long as the payload 202 is oriented in line with the steepest gradient.

The payload 202 can also be related to a virtual bushing joint 203. The virtual bushing joint 203 is an imaginary joint with three prismatic and three revolute primaries, meaning it has six degrees of freedom (6DOF) to enact translational movement in the x, y, and z axes as well as rotate around all three axes. The virtual bushing joint 203 does not physically exist in the system 200 but is useful for model-based design of the controller (not shown). The detected error from the accelerometer 205 indicates how the virtual bushing joint 203 should move to allow for the overall system to achieve the desired orientation. A command is then generated to the adjust the virtual bushing joint 203 with respect to the ground plane 210 (which is coincident with the payload frame 200). The payload 202—and all its solid components, motors 204A-D, and linear actuators 208A-D—are to follow the virtual bushing joint 203 as if rigidly connected to it. The actuation of the motors 204A-D is modeled to observe the linear motion that occurs in simulation. These modeled actuations are used to determine corresponding commands for each motor 204A-D.

Figure 3:
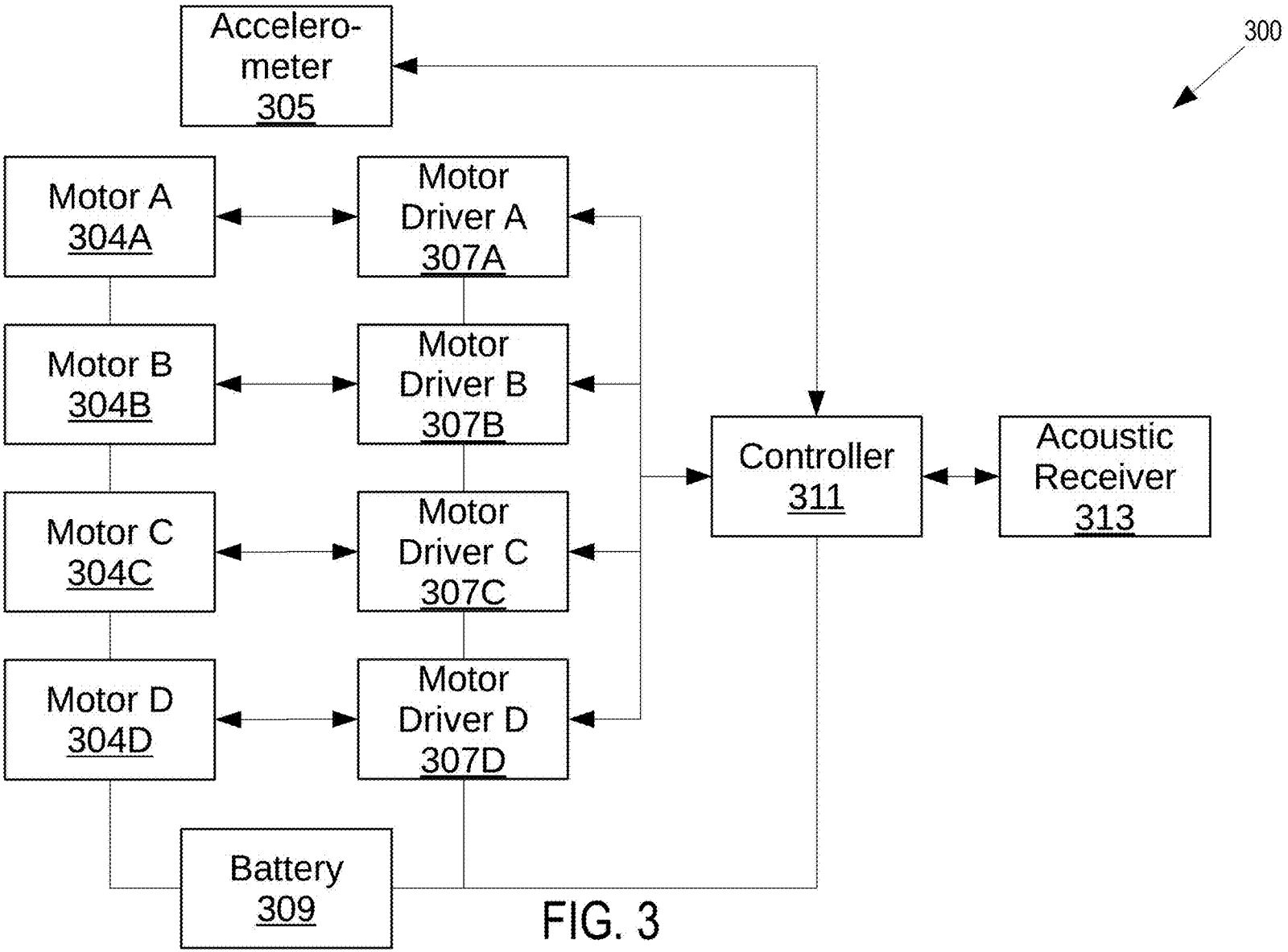
FIG. 3 shows an example schematic of electromechanical components of a payload frame in accordance with embodiments.

FIG. 3 shows an example schematic of electromechanical components 300 of a payload frame in accordance with embodiments. The electromechanical components 300 include motors 304A-D, an accelerometer 305, motor drivers 307A-D, a battery 309, a controller 311, and an acoustic receiver 313. The motors 304A-D and accelerometer 305 may correspond to the motors 204A-D and accelerometer 205 as described above with respect to FIG. 2. The battery 309 provides power to the motors 304A-D, motor drivers 307A-D, and the controller 311, which can further relay power to the accelerometer 305 and the acoustic receiver 313.

The controller 311 sends commands to the motor drivers 307A-D to control actuation of the motors 304A-D. The controller determines an actuation command proportional to the error of the accelerometer 305, based on the inverse kinematics solver inherent in the connection between the virtual bushing joint 203 and the rest of the payload frame 200. The sequence of actuation commands is provided by the controller 311 each time a feedforward loop is completed to reduce any steady-state error from the original iteration. Accordingly, combining each characteristic, the controller 311 can be defined as an inverse kinematics iterative proportional (IKIP) controller. One advantage to this technique is that unless the payload frame 200 becomes unstable due to tipping from an external force, it is unlikely to have any overshoot. With a payload frame 200 for water body bed deployment, overshoot can be catastrophic in that the payload 202 can tip over and be unable to right itself. A disadvantage of this techniques is that there is the possibility of having steady stead error, as well as compounding error with each iteration.

Using a simulated IKIP controller 311 with a virtual bushing joint 203 for the payload 202 described above, a model of the payload frame 200 was executed over 8,281 simulations. In the simulations, the payload frame 200 is rigidly connected to the payload 202, with gravity applied at the body's center of gravity. A smooth step function similar to as described below for FIG. 4 is applied to the rotational commands provided by the controller 311 with respect to the virtual bushing joint 203. The simulation measures Euler angles to simulate the accelerometer 305 and the motor 304A-D commands are measured in terms of position-velocity-acceleration to a scope and the workspace for follow-on data analysis.

Each simulation started the water body bed plane at a different angle, ranging from −45° to 45° in 1° increments, with respect to the payload frame's 200 x- and y-axis. The maximum allowable angular error defined as 5.4° and the maximum allowable lateral error is 0.095 m, or 3.75 in.

From both the angular and translational data plots obtained from the simulations, it is determined that if the water body bed is only rotated around one axis with respect to the payload's 202 coordinate system, then error is near zero. Accordingly, it is beneficial for the payload's accelerometer 305 to be oriented so that the its x and y coordinates are in line with the motors 304A-D. As discussed above, the vessel or AUV should deploy the payload 202 so that the payload 202 accelerometer's 305 coordinate system's x-axis or y-axis is coincident with the steepest gradient of the water body bed.

Trials with a prototype payload frame 202 were performed to determine linear actuation needed for driving the virtual bushing joint 203 to an orientation of [0, 0] for roll and pitch. The prototype microcontroller 311 was used to read and write data and then integrated into a MATLAB file that implemented the model based IKIP controller described above. Those skilled in the art will appreciate that the modeling could be performed similarly for other target orientations.

In a first trial, the IKIP controller 311 performed deployments with an initial roll of about −18.5° and pitch of about −4°. During the first trial, there are significant motor command oscillations throughout, but the payload frame 202 does converge to zero after 12 iterations. The payload frame 202 achieves the desired 5.4° angular error threshold by iteration 10.

In a second trial, the payload frame 200 drives to zero faster with initial roll and pitch angles of −20° and −2.5°. The payload frame 200 achieves the angular error threshold by iteration 7, although iteration 4 nearly brought the overall angular error back to its starting position. Nevertheless, in this trial, the payload frame 200 behaved desirably with a faster settling time than the first trial, even though the only difference with the setup was that the initial conditions were switched so that there was greater error in roll initially.

In a third trial, the payload frame 200 happens to drive to zero very quickly. When observing the payload frame 200 during this trial, it became clear on the second iteration that the payload frame 200 "skipped" position as the lead screws 208A-D went from rubbing against each other to unimpeded, resulting in a very effective correction but perhaps by chance. Features can be added to the design so that the lead screws 208A-D do not interfere with each other. Nevertheless, the inverse kinematics iterative proportional (IKIP) controller 311 succeeded in driving the payload frame 200 to point directly downward when positioned on an uneven water body bed.

To improve the prototype payload frame 200 further, the linear position of each actuator 208A-D is recorded after each iteration and updated into its model. Then, a threshold of one degree is applied for roll and pitch, so that the same workflow repeats until the criteria are met. Over the course of six iterations, the motor commands derived from the model's inverse kinematics solver approaches zero.

The iterative approach ensures that with reasonable initial conditions, the payload frame 200 can stabilize. This approach certainly does not concern itself with monitoring or controlling angular velocity or acceleration, but in some applications like this one such control is not necessary. The success of the IKIP controller 311 may be able to serve as a testament to the philosophy that sometimes rougher estimation may control a system more robustly in situations where there are so many unknowns. If the kinematics and dynamics of the system were to be defined with exquisite detail, the risk of "overfitting" the system model occurs, allowing for the possibility that some unexpected error that could occur with the system after deployment from the vessel or AUV, some unanticipated environmental factor, or an unforeseen disturbance makes the system respond in an undesirable way. The iterative approach, however, ensures that for most situations, the payload frame 200 can eventually respond in the desired manner, even a design requirement like angular velocity is sacrificed in this case.

The acoustic receiver 313 on the payload 202 processes a signal produced by an active source, a transducer onboard an AUV or other vehicle, from a distance. In response to the signal, the controller 311 can initiate commands for orientating the payload 202 in the target orientation.

FIG. 4 shows an example smooth step function 400 in accordance with embodiments. Because the motors 304A-D do not turn instantaneously, it is useful to model a smooth-step function for linear actuation. The smooth step function 400 shows the mathematical operations implemented, which have tunable parameters including "final value" of the smooth-step function in meters, the settling time in seconds ("period"), and time at which the function takes effect ("ramp start time").

Clock 442 displays and provides simulation time as an output. Time sum 444 subtracts tmean 446 from simulation time. Tmean 448 is a constant value provided into the time sum 444. Saturation 446 limits input signal to a predefined upper/lower limit. Sine function 450A-B applies a sinusoidal function. -K- 452A-B is a constant gain multiplier. Gain sum 454 adds the output of 452A to -C- 456, where -C- 456 a gain constant value. U/Y fcn 458 is a custom function provided by the user with input u and output y. X 460 multiples the output of 450A and 458. Mux 462 combines input signals of the same data type and complexity into a virtual vector, which is then provided as output 464 to the model.

Embodiment described above have a payload that is only able to rotate about two axes, although yaw is slightly altered during actuation and translational degrees of freedom are achieved prior to detachment from the vessel or AUV. In other embodiments, the payload can retain rotational DOF but also have organic translational freedom to add robustness to the payload's ability to accurately maintain a desired attitude. In particular, quaternions have the advantage of allowing for easier design of control algorithms through the quaternion error and "dual quaternions, a representation of the special Euclidean group SE(3), are an efficient method for representing rigid body transformations, expressing both rotation and translation" as noted by W. D. Price et al in the related literature. In yet other embodiments, the payload can be equipment with wheels to allow the payload to further localize based on the detected target location.

Embodiments described herein could be secured underneath the AUV with a hydrodynamically designed nose cap. In this case, a servo motor could rotate a positive block that holds the payload on, and with its bottom-heavy design it will land upright. In addition, the AUV would generally need the ability to hold station, preferably with the use of cross-tunnel thrusters. Finally, because of the error incurred when the accelerometer is not aligned with the steepest incline on the water body bed, the AUV should position itself accordingly to prevent error in the payload's attitude control.

In yet other embodiments, a more efficient algorithm to determine the Inverse Kinematics Iterative Proportional controller's commands could be used to improve performance and allow for more advanced control techniques.

The invention may be implemented on virtually any type of computer system regardless of the platform being used. For example, a computer system can include a processor, associated memory, a storage device, and numerous other elements and functionalities typical of today's computers. The computer may also include input means, such as remote controllers, and output means, such as a display. The computer system may be connected to a local area network (LAN) or a wide area network (e.g., the Internet) via a network interface connection. Those skilled in the art will appreciate that these input and output means may take other forms.

Further, those skilled in the art will appreciate that one or more elements of the computer system may be located at a remote location and connected to the other elements over a network. Further, the invention may be implemented on a distributed system having several nodes, where each portion of the invention may be located on a different node within the distributed system. In one embodiment of the invention, the node corresponds to a computer system. Alternatively, the node may correspond to a processor with associated physical memory. The node may alternatively correspond to a processor with shared memory and/or resources. Further, software instructions to perform embodiments of the invention may be stored on a computer readable medium such as a compact disc (CD), a diskette, a tape, a file, or any other computer readable storage device.

This disclosure provides exemplary embodiments of the present invention. The scope of the present invention is not limited by these exemplary embodiments. Numerous variations, whether explicitly provided for by the specification or implied by the specification or not, may be implemented by one of skill in the art in view of this disclosure.

What is claimed is:

1. A payload frame for deploying a payload underwater, the payload frame comprising:

at least three lead screws, each lead screw connected near a top end of the lead screw to the payload by a corresponding spherical bearing;

at least three motors, each motor connected to a bottom end of one of the lead screws, the motor to rotate the lead screw through the corresponding spherical bearing;

at least three feet, each foot attached to one of the motors, the feet to support and secure the payload frame on a water body bed;

an accelerometer attached to the payload, the accelerometer to measure gravity vectors of the payload; and a microcontroller connected to the accelerometer and the motors, the microcontroller to:

receive the gravity vectors from the accelerometer; and control each of the motors based on the gravity vectors to position the payload in a target orientation.

2. The payload frame of claim 1, wherein the target orientation is determined using a virtual bushing joint of the payload, the virtual bushing joint defining six degrees of freedom for the payload with respect to the water body bed.

3. The payload frame of claim 2, wherein the microcontroller controls the motors by:

determining a predicted signal error for moving the payload to the target orientation;

determining an actuation command for the motors that is proportional to the signal error and based on an inverse kinematics solver for a connection between the virtual bushing joint and the payload frame; and executing the actuation command to control each of the motors.

4. The payload frame of claim 1, wherein each of the lead screws has a diameter of approximately 10 mm, a lead of approximately 12 mm, a right-hand thread direction, and a lead angle of approximately 50°.

5. The payload frame of claim 1, wherein each of the spherical bearings has a rotational range of approximately plus or minus 45° around an x and y axes of the spherical bearing.

6. The payload frame of claim 1, wherein each of the motors is connected to the one of the lead screws using a worm gear.

7. A method for deploying a payload underwater, the method comprising:

attaching the payload to a payload frame, the payload frame comprising at least three legs;

configuring the payload frame according to physical characteristics of the payload;

releasing the payload frame in a water body; and after the payload frame reaches a water body bed, adjusting a length of the legs according to gravity vectors from an accelerometer to position the payload in a target orientation.

8. The method of claim 7, wherein configuring the payload frame comprises modeling an adjustment in length of one of the legs to determine lead screw parameters for adjusting the length of the legs.

9. The method of claim 7, further comprising using a virtual bushing joint of the payload to determine the target orientation, the virtual bushing joint defining six degrees of freedom for the payload with respect to the water body bed.

10. The method of claim 9, wherein adjusting the length of the legs further comprises:

determining a predicted signal error for moving the payload to the target orientation;

determining an actuation command for the legs that is proportional to the signal error and based on an inverse kinematics solver for a connection between the virtual bushing joint and the payload frame; and executing the actuation command to adjust each of the legs.

11. A non-transitory computer-readable medium comprising executable instructions for causing a computer processor to:

configure a payload frame according to physical characteristics of a payload, wherein the payload frame comprises at least three legs, and wherein the payload is attached to the payload frame; and after the payload frame reaches a water body bed, adjust a length of the legs according to gravity vectors from an accelerometer to position the payload in a target orientation.

12. The non-transitory computer-readable medium of claim 11, wherein configuring the payload frame comprises modeling an adjustment in length of one of the legs to determine lead screw parameters for adjusting the length of the legs.

13. The non-transitory computer-readable medium of claim 11, further comprising using a virtual bushing joint of the payload to determine the target orientation, the virtual bushing joint defining six degrees of freedom for the payload with respect to the water body bed.

14. The non-transitory computer-readable medium of claim 13, wherein adjusting the length of the legs further comprises:

determining a predicted signal error for moving the payload to the target orientation;

determining an actuation command for the legs that is proportional to the signal error and based on an inverse kinematics solver for a connection between the virtual bushing joint and the payload frame; and executing the actuation command to adjust each of the legs.

* * * * *